United States Patent [19]

Bachle

[11] 4,248,490

[45] Feb. 3, 1981

[54] LAY-IN LUG WITH CONDUCTION PAD

[75] Inventor: Walter W. Bachle, Harwinton, Conn.

[73] Assignee: General Signal Corporation, Stamford, Conn.

[21] Appl. No.: 36,916

[22] Filed: May 7, 1979

[51] Int. Cl.[3] ..... H01R 4/66

[52] U.S. Cl. ..... 339/14 R; 339/251; 339/264 R; 339/272 UC

[58] Field of Search ..... 339/14 R, 14 L, 251, 339/264, 272 R, 272 UC

[56] References Cited

U.S. PATENT DOCUMENTS

| | | | |
|---|---|---|---|
| 2,239,100 | 4/1941 | Jackson | 339/272 UC |
| 3,492,625 | 1/1970 | Bromberg | 339/14 R |

*Primary Examiner*—John McQuade
*Assistant Examiner*—DeWalden W. Jones
*Attorney, Agent, or Firm*—Milton E. Kleinman; George W. Killian

[57] ABSTRACT

A lay-in lug which may be used for a grounding connection by securing it to a conductive bushing, or the like, is disclosed. The lug comprises a body member for providing strength and rigidity and a conducting member, supported by the body member, for providing a low resistance conduction path. The conducting member is in direct contact with both the laid-in wire and the bushing, or the like, whereby a low resistance conduction path is provided between the wire and the bushing. First and second clamping means secure the lug to the bushing and hold the wire in contact with the conducting means, respectively. The conducting member may be selectively removable from the body member and may include a turned-up lip for helping to retain a wire in contact therewith. The conducting member may also include means for inducing slight deformation of a wire compressed thereagainst to increase the pull-out force required to extract the wire. The conducting member adjusts, by mild deformation, to bushings of various configurations.

18 Claims, 7 Drawing Figures

LAY-IN LUG WITH CONDUCTION PAD

BACKGROUND OF THE INVENTION

Lay-in lugs have a "C" shape to permit laying in a wire. Such lugs may be used in a wide variety of applications and are especially well suited for use as a grounding device for electrical equipment such as bushings, or the like, and will be particularly described in this connection. Lay-in lugs for electrical fittings are disclosed in U.S. Pat. Nos. 3,365,693, issued Jan. 23, 1968, to Frank L. Browne; and 3,706,959, issued Dec. 19, 1972, to Alexander R. Norden; both of which are assigned to the same assignee as the present invention. Grounding lugs are provided to facilitate the grounding of exposed metallic surfaces such as a conduit and/or other electrical fittings. The grounding connection is frequently made through a bushing which may be threaded onto the end of a conduit as at a service box where the conduit passes through a wall of the box. Grounding lugs of this type are generally adapted to be secured by one or more screws to the periphery of the conduit bushing, and are adapted to receive the grounding wire, preferably without requiring the wire to be cut. The lay-in lug is convenient to use but, when tightened, comprises a highly stressed structure and must, therefore, be fabricated of suitable materials having a high yield strength. If a high yield strength material is not used, adequate pressure could not be applied to the laid-in wire. Typically, a clamping screw is provided for securing the wire within the lug. Under ground fault conditions, a very large ground current may pass through the grounding wire and the lug; and therefore it is important that the lug provide a suitable low-resistance connection. Under fault conditions the ground current may rise to thousands of amperes. Unless good conductivity is provided between the grounding wire and the bushing, the large current may cause sufficient heat to melt or even vaporize the lug. This may result in loss of the grounding connection, circuit failure, danger to personnel and equipment damage or fire. Accordingly, efforts have been made to improve the conductivity between the grounding wire and the bushing, or the like.

Prior art devices have, for the most part, attempted to provide the desired low resistance by providing more massive lugs and/or larger areas of contact together with large supporting screws. These devices must be made of a high-strength material so that the connector will not yield appreciably when a wire or cable is securely tightened by the wire-holding screw. Unfortunately, materials with high-yield strength have poor conductivity when compared with materials such as copper, aluminum or their alloys. Therefore, connectors made from high-strength materials will be subject to significant internal heating in response to the presence of a large fault current. The large currents, frequently encountered in the field under ground fault conditions, severely limit the utility of grounding lugs that have a high internal resistance, for two reasons. One is that the connector will become hot while passing a large current because of the internal resistance of the connector material and thereby cause it to melt and destroy the connector, which results in a discontinuity of the electrical grounding circuit. Another limitation is the result of the fault current being passed through the connector's mounting screw, causing the screw to heat and melt and thereby break the grounding circuit. This is a direct result of current being shunted through the screw, since the alternate current paths through the connector's body have a high resistance relative to that of the screw.

SUMMARY OF THE INVENTION

The structure of the present invention overcomes the difficulties and disadvantages of the prior art by providing a grounding lug comprising two major components; one of which provides the requisite strength, while the other provides the requisite conductivity. The conduction member is formed and oriented so that it is supported by the strong body member and yet is in direct contact with both the ground wire and the bushing, or the like, on which the structure is mounted. Inasmuch as the conduction member has the requisite conductivity, or low resistance, it will not heat excessively in response to large currents. In addition, since current always takes the path of least resistance, only a nominal current will pass through the body member and/or mounting screw; and, accordingly, they will not overheat and melt. The body member may comprise a suitable ferrous alloy such as stainless steel, and the conducting member may comprise copper or a suitable conductive alloy. A first fastening means, such as a screw, is provided to secure the body member and the associated conducting member to the bushing, or the like, in a predetermined relationship so that wings of the conducting member are compressed between the bushing and the wings of the body member. The conduction member is designed to permit some deformation as the first fastening means is tightened so that the conducting member can yield and conform to the configuration of the bushing and thereby maximize the area of contact therebetween. The conduction member may also include turned-up legs, or lips, to help retain the grounding wire in the lug assembly. A second fastening means secures and clamps the grounding wire in firm contact with the conduction member. To improve the contact and grip between the grounding wire and the conduction member, the latter may include serrations. The portion of the conduction member in contact with the grounding wire comprises two pads joined by a bridge or saddle. The saddle portion of the conduction pad provides for the aforementioned yielding; and with the open part under the saddle situated in axial alignment with the second fastening means the grounding wire is subjected to some deformation in response to tightening the second fastening means, thereby increasing the pull-out force required to pull the wire from the lug.

In normal applications the lay-in lug will be attached to the bushing at the time the bushing is installed. Because it saves space to have bushings close together, or close to other apparatus, it is desirable to provide a bushing and lug assembly with the smallest possible maximum radius. This desirable feature has been achieved through the effective use of a high strength body member and a low resistance conduction member associated in cooperative relationship.

From the foregoing it will be appreciated that:

It is a primary object of the invention to provide a new and improved grounding lug.

It is a more specific object of the invention to provide a grounding lug with improved conductivity.

It is another object of the invention to provide a grounding lug with improved conductivity and without any loss of strength.

It is another object of the invention to provide a grounding lug which can pass fault currents without being destroyed.

It is another object of the invention to provide a grounding lug which includes a separable conducting pad in direct contact with the grounding wire and the bushing, or the like.

It is another object of the invention to provide a grounding lug which includes a conducting pad which can yield, allowing it to conform with the configuration of the associated bushing, or the like.

It is another object of the invention to provide a grounding lug which encourages some deformation of the grounding wire to increase the force required for pull-out.

It is another object of the invention to provide the above desired features in a lay-in lug.

It is another object of the invention to provide a lay-in lug with the aforementioned features and which has a minimum turning radius.

BRIEF DESCRIPTION OF THE DRAWING

Further objects and advantages of the invention will become apparent as the following description is considered together with the accompanying drawing, in which.

Any given element has the same identifying number in all views.

DESCRIPTION OF THE PREFERRED EMBODIMENT

Figure 1:
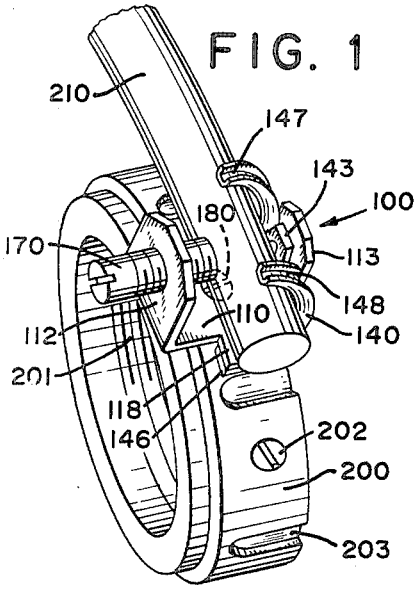
FIG. 1 comprises a perspective view of the structure of the invention assembled on a bushing.

Considering now more specifically the drawing, and particularly FIG. 1, there will be seen a lay-in grounding lug indicated generally as 100 which is mounted on a bushing 200. The grounding lug 100 comprises a body member 110, a wire conduction pad 140, a wire clamping screw 170, and a mounting screw 180, seen most clearly in FIG. 3. The bushing 200 may include threads 201 for threading the bushing 200 onto the end of a threaded conduit (not shown) for connecting the conduit to a panel or distribution box (not shown) all in a manner with which those familiar with these devices are well acquainted. The bushing 200 includes a screw 202 which locks the bushing to the conduit and improves the electrical conductivity between the bushing 200 and the conduit. The bushing 200 includes a plurality of notches 203 distributed around the outer surface of the bushing 200 to facilitate grasping and turning the bushing 200 with an appropriate tool.

Figure 3:
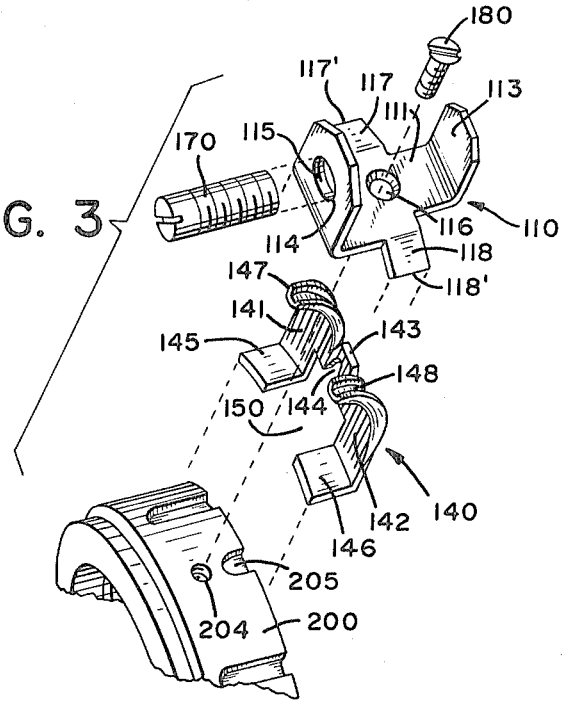
FIG. 3 is an exploded view of the principle components of the structure of the invention.

The individual components of the grounding lug 100 are most easily seen in FIG. 3. As may be seen, the body member 110 has a back member 111, a top member 112, and a bottom member 113. The top member 112 includes a hole 114 having threads 115 to accommodate the wire clamping screw 170. The back member 111 includes a hole 116 which is counter-sunk and of sufficient diameter to pass the body of mounting screw 180 therethrough, so that the mounting screw 180 may be threaded into the threaded hole 204 of the bushing 200. As may be seen, the back member 111 has wings 117 and 118 which extend from either side thereof.

The wire conduction pad 140 constitutes an electrical shunt and includes first and second wire conduction pads 141 and 142 which are joined together by a bridge or saddle link 143. As may be seen, the bridge or saddle link 143 has a void space 144 (see FIG. 4). Joined to the wire conduction pads 141 and 142 are bushing conduction pads 145 and 146, respectively. The bushing conduction pads 145 and 146 are at approximately 90 degrees with respect to the wire conduction pads 141 and 142. As may be seen in every Figure, except FIG. 7, the conduction pad 140 is fabricated with wire retaining legs 147 and 148, which, as may be seen in FIG. 1, serve to retain the ground wire 210.

As may be readily envisioned by those familiar with the fabrication of devices of this sort, both the body member 110 and conduction pad 140 may be stamped and formed, with the body member 110 subsequently hardened and tempered.

Figure 2:
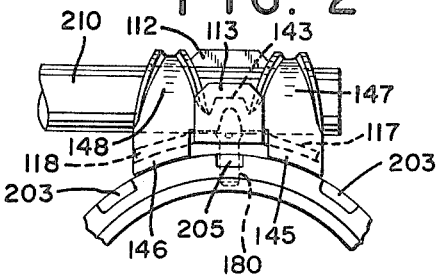
FIG. 2 is a bottom view of a portion of the assembly of FIG. 1.

As may be seen in FIGS. 2 and 3, the bushing 200 includes a guide notch 205 which is formed during casting of the bushing 200 to identify where the threaded hole 204 is to be located.

Figure 4:
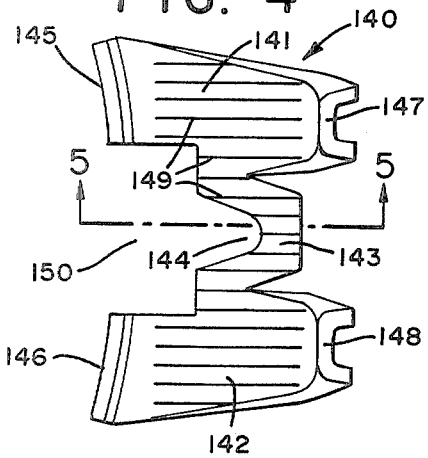
FIG. 4 is a top view of the conduction pad.
Figure 5:
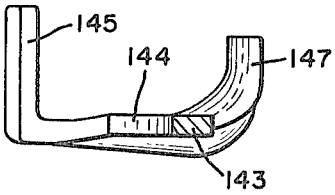
FIG. 5 is a cross section view of the conduction pad taken on the lines 5—5 of FIG. 4.

As may be seen in FIGS. 3 and 4, the conduction pad 140 may include serrations 149 on the wire conduction pads 141 and 142.

Figure 6:
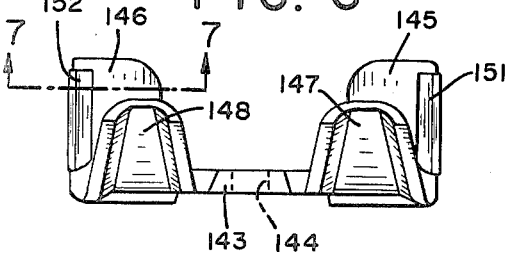
FIG. 6 is a front view of the conduction pad.
Figure 7:
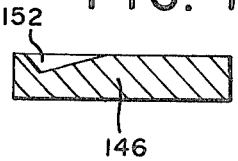
FIG. 7 is a cross section view of the conduction pad taken on the lines 7—7 of FIG. 6.

As may be more clearly seen in FIGS. 6 and 7, the conduction pad 140 includes formed indentations 151 and 152 in the bushing conduction pads 145 and 146, respectively.

The manner in which the body member 110 and the conduction pad 140 are assembled to provide the grounding lug structure 100 will be readily apparent from considering the elements as shown in FIGS. 1 and 3. More specifically, it may be seen that the bottom member 113 may be slipped through the space 150 of the conduction pad 140 and the parts arranged so that the upper surface of the bottom member 113 is in contact with the lower surface of the saddle portion 143 of the conduction pad 140, all as illustrated in FIG. 1. Simultaneously, the wings 117 and 118 will reside on top of the bushing conduction pads 145 and 146. Accordingly, as the grounding lug 100 is attached to the bushing 200 by the mounting screw 180 it will be seen that the wings 117 and 118 press against the bushing conduction pads 145 and 146, respectively, to press them into firm contact with the surface of bushing 200. Furthermore, the edges 117' and 118' match into their respective formed indentations 152 and 151. This helps to align the conduction pad 140 with the body member 110 while screw 180 is tightened. In addition, tightening of the mounting screw 180 and the pressure of the wings 117 and 118 against the conduction pads 141 and 142 tend to deform the conduction pad 140 by bending at the saddle 143. The bending and distortion cause the bushing conduction pads 145 and 146 to mate with the curvature of the bushing 200 irrespective of the radius of curvature of the bushing 200. That is, mounting the grounding lug 100 on the bushing 200 provides a self-accommodation to provide maximum area of contact between the bushing conduction pads 145 and 146 and the bushing 200 to provide a minimum resistance path between the conduction pad 140 and the bushing 200.

With the wire clamping screw 170 backed away from the conduction pad 140, a ground wire 210 may be laid into the opening and placed in contact with the wire conduction pads 141 and 142, and thereafter the wire clamping screw 170 may be tightened to press the grounding wire 210 against the conduction pad 140. Although the grounding wire 210 is shown as a solid member, it should be understood that conventional stranded wire may be employed. The wire retaining legs 147 and 148 serve to retain the grounding wire 210 in position. It will be readily apparent that, if desired, one or more wire retaining legs could be formed on the bottom member 113 of the body member 110 instead of, or in addition to, the retaining legs 147 and 148 on the conduction pad 140.

As is most clearly seen in FIG. 4, the wire conduction pads 141 and 142 may include serrations 149 which serve at least two functions. First, the serrations help bite into the grounding wire 210 to improve the electrical contact therebetween. In addition, the serrations 149 cause a slight deformation of the grounding wire 210, thereby providing a more secure grip and increasing the longitudinal pull-out force required to pull out the grounding wire 210. In addition, the void, or space, 144 which provides the saddle 143 to permit the deformation of the conduction pad 140 as already mentioned, promotes further deformation of the grounding wire 210 inasmuch as the space 144 is in substantially axial alignment with the wire clamping screw 170, so that tightening the wire clamping screw 170 presses a portion of the grounding wire 210 into the space 144, thereby further increasing the pull-out force. It will be apparent that the thicknesses, proportions and screw sizes may vary from one model to another depending upon the range of wire sizes that are to be accommodated and/or the range of the bushing sizes which may be associated with the grounding lug 100. However, any given structure may be used with at least a few different wire sizes and bushings of different diameters. Although the grounding lug 100 is shown as used with a bushing 200, it will be evident that the same or similar grounding lugs may be used with other devices, such as: motor or generator housings, distribution boxes, panel boards, and other structures with which those familiar with the art are well acquainted.

It will be apparent to those familiar with these devices that an alternate structure, with similar advantages and features, could be made with an altered conduction pad and body member wherein the conduction pad has no saddle member between the elements 141 and 142 but does use a connecting link between elements 145 and 146. In such structure the bottom element 113 would probably be wider to support the pads 141 and 142. Wire retaining legs could be formed on either the body member or the conduction member. In this design, the bottom member might have cut-away portions to accommodate the elements 141 and 142 whereby the surface on which the wire lies does not have abrupt level changes.

While there has been shown and described what is considered at present to be a preferred embodiment of the invention, modifications thereto will readily occur to those skilled in the related arts. For example, two mounting screws might be used to inhibit rotation of the grounding lug 100 and/or a tang from the body member could be made to engage the guide notch 205. Also, it will be apparent that the design could be modified to accommodate a grounding wire at some other angle with respect to the bushing. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiment shown and described, and it is intended to cover in the appended claims all such modifications as fall within the true spirit and scope of the invention.

What is claimed is:

1. A lay-in grounding lug to be secured to a bushing or the like, and comprising in combination:

(a) a body member fabricated of a high yield strength material for resisting deformation and having a back member from which top and bottom members extend from opposite limits of said back member;

(b) a low resistance conduction member including a first surface portion formed and selectively positioned for cooperative relationship with and support from said bottom member of said body member when said conduction member is positioned to overlay said bottom member, and said conduction member further including a second surface portion formed and positioned for cooperative relationship with said back member of said body member when said conduction member is selectively positioned as recited so that said second surface portion will make surface contact with the surface of any bushing, or the like, with which the lay-in grounding lug may be cooperatively associated;

(c) first clamping means cooperating with said body member for clamping the combination of said body member and said conduction member, when positioned as recited, to a bushing, or the like; and (d) second clamping means threadingly engaged with said top member and projecting towards said bottom member and said first surface portion of said conduction member whereby a wire laid over said first surface portion of said conduction member may be clamped in physical contact with said first surface portion of said conduction member by said second clamping means.

2. The combination as set forth in claim 1 wherein said lay-in grounding lug includes a turned-up lip for retaining a wire laid over said first portion.

3. The combination as set forth in claim 2 wherein said turned-up lip comprises a part of said first portion of said conduction member.

4. The combination as set forth in claim 3 wherein said conduction member is selectively separable from said body member.

5. The combination as set forth in claim 1 wherein said first portion of said conduction member includes deforming means for producing at least some deformation of a wire laid over said first portion and clamped by said second clamping means.

6. The combination as set forth in claim 5 wherein said deforming means includes a void in said conduction member in axial alignment with said second clamping member.

7. The combination as set forth in claim 6 wherein said void in said conduction member causes said first portion of said conduction member to have a saddle portion.

8. The combination as set forth in claim 7 wherein said saddle portion constitutes the most easily deformed portion of said first portion of said conduction member.

9. The combination as set forth in claim 1 wherein said first clamping means comprises a threaded member passing through a hole in said back member.

10. The combination as set forth in claim 9 wherein said second portion of said conduction member includes a void in axial alignment in said first clamping means and wherein the area of said void is more than double the cross sectional area of said first clamping means.

11. A lay-in grounding lug to be secured to a bushing or the like, and comprising in combination:

(a) a body member fabricated of a high yield strength material and including a back member and top and bottom members extending from opposite ends of said back member and having parallel portions;

(b) a conduction member fabricated of a material having superior electrical conducting characteristics, as compared with said body member, and including a first portion supported at least in part by said bottom member so that at least part of the surface of said first portion is no further from said top member than the closest part of said bottom member;

(c) said first portion of said conduction member comprising first and second pads joined together by a saddle member and wherein (d) said first and second pads each have an extension for overlaying at least a part of the surface of said back member facing towards the bushing, or the like to which the lay-in grounding lug may be secured.

12. The combination as set forth in claim 11 and including first clamping means for clamping the lay-in lug to the bushing, or the like.

13. The combination as set forth in claim 12 wherein said first portion of said conduction member is subjected to deformation, at least at said saddle member, in response to the compression of said extensions of said first and second pads between said back member and the bushing, or the like.

14. The combination as set forth in claim 11 wherein said conduction member is selectively removable from said body member.

15. The combination as set forth in claim 14 wherein said lay-in lug includes a turned-up lip for retaining a wire laid in said lug.

16. The combination as set forth in claim 15 wherein said turned-up lip comprises a part of said first portion of said conduction member.

17. The combination as set forth in claim 11 wherein said first portion of said conduction member includes serrations on the surface facing said top member.

18. The combination as set forth in claim 11 wherein at least a part of said first portion of said conduction member overlays at least a part of the surface of said bottom member facing said top member.

* * * * *